US009035542B2

(12) United States Patent
Tokura et al.

(10) Patent No.: US 9,035,542 B2
(45) Date of Patent: May 19, 2015

(54) DRIVING IC-INCORPORATED FLUORESCENT DISPLAY DEVICE

(71) Applicants: Futaba Corporation, Mobara-shi, Chiba (JP); Taiwan FUTABA Electronics Corporation, Kaohsiung (TW)

(72) Inventors: Katsushi Tokura, Mobara (JP); Ping Ning Chiu, Kaohsiung (TW); Ming Chun Wang, Kaohsiung (TW); Mei Hui Shu, Kaohsiung (TW); Shang Hsu Chin, Kaohsiung (TW)

(73) Assignee: FUTABA CORPORATION, Kaohsiung (TW)

( * ) Notice: Subject to any disclaimer, the term of this patent is extended or adjusted under 35 U.S.C. 154(b) by 0 days.

(21) Appl. No.: 14/060,158

(22) Filed: Oct. 22, 2013

(65) Prior Publication Data

US 2014/0117849 A1 May 1, 2014

(30) Foreign Application Priority Data

Nov. 1, 2012 (JP) ..... 2012-241424

(51) Int. Cl.
*H01K 1/18* (2006.01)
*H01J 61/10* (2006.01)

(52) U.S. Cl.
CPC ..... *H01J 61/10* (2013.01)

(58) Field of Classification Search
CPC ..... H01J 2329/8635; H01K 1/18
USPC ..... 313/272, 495–496; 315/56
See application file for complete search history.

(56) References Cited

U.S. PATENT DOCUMENTS

| | | | | |
|---|---|---|---|---|
| 7,012,361 | B2 * | 3/2006 | Kanesaka | 313/493 |
| 2002/0021082 | A1 * | 2/2002 | Uemura et al. | 313/495 |
| 2011/0279425 | A1 * | 11/2011 | Maeda | 345/206 |
| 2014/0117849 | A1 * | 5/2014 | Tokura et al. | 315/56 |

FOREIGN PATENT DOCUMENTS

| | | | |
|---|---|---|---|
| JP | S6446948 | U | 3/1989 |
| JP | H08007810 | A | 1/1996 |
| JP | 2003031168 | A | 1/2003 |
| JP | 2005209354 | A | 8/2005 |
| JP | 2011243377 | A | 12/2011 |

OTHER PUBLICATIONS

Japan Patent Office, Office Action, Application No. 2012-241424, Nov. 11, 2014, 3 pages.

* cited by examiner

*Primary Examiner* — Jason M Crawford
(74) *Attorney, Agent, or Firm* — Quarles & Brady LLP

(57) ABSTRACT

In a driving IC-incorporated fluorescent display device, a filament end-supporting member including a structure which has a short distance between a filament and an anode substrate and is not compromised to shielding effect of the driving IC is provided. An end portion of the filament is sandwiched between a tabular support which is attached to a tabular portion of a retainer plate and a ribbon, and the ribbon is fixed to the support by spot welding. The support consists of a slit. The filament is opposed to the slit and extends to longitudinal direction of the slit. The opposite side of the filament of the slit is closed by the retainer plate.

8 Claims, 5 Drawing Sheets

DRIVING IC-INCORPORATED FLUORESCENT DISPLAY DEVICE

CROSS-REFERENCE TO RELATED APPLICATIONS

This application claims the benefit of and priority from the Japanese Patent Application No. 2012-241424, the contents of which is incorporated herein by reference.

BACKGROUND OF THE INVENTION

1. Field of the Invention

This invention relates to a fluorescent display device incorporating its driving IC therein, more particularly, relates to a structure of a filament end-supporting member of the fluorescent display device.

2. Background of the Invention

There has been conventionally proposed a fluorescent display device incorporating its driving IC therein (i.e., a driving IC-incorporated fluorescent display device), and having a retainer plate and a support of a filament end-supporting member as a shielding member to shield and protect the driving IC from electrons emitted from a filament (i.e., cathode).

FIGS. 4A and 4B are cross-sectional views of the conventional driving IC-incorporated fluorescent display device, and having the filament end-supporting member having the retainer plate and the support, as the shielding member.

FIG. 4A is a cross-sectional view of FIG. 4B taken along line X13-X13, and FIG. 4B is a cross-sectional view of FIG. 4A taken along line X12-X12.

The filament end-supporting member includes a retainer plate 21 and a support 22. The retainer plate 21 is provided with a rising portion 211 and a tabular portion 212, and the both ends of the retainer plate 21 are drawn from a joint portion X11 between an anode substrate 11 and a side plate (i.e., side member) 12 to outside of an enclosure. The support 22 includes a tabular portion 221, a rising portion 222, and a filament-attaching portion 223, and the tabular portion 221 of the support 22 is spot welded to the tabular portion 212 of the retainer plate 21. The end portion of a filament F is sandwiched between the filament-attaching portion 223 of the support 22 and a ribbon 23, and the ribbon 23 is fixed to the filament-attaching portion 223 by spot welding. The tabular portion 212 of the retainer plate 21 and the tabular portion 221 of the support 22 lie between the filament F and the driving IC 24 so as to function as shielding members of the driving IC 24. Furthermore, the reference numeral 25 indicates an anode electrode, which forms a fluorescent film.

The filament end-supporting member in FIG. 4 is formed of the retainer plate 21 and the support 22, and the support 22 includes the rising portion 222. For the reason, the distance between the filament F and the anode electrode 25 (height of the filament) becomes large. In other words, the height of the filament increases.

Therefore, in order to suppress the height of the filament F, there has been proposed a new filament end-supporting member in which the support 22 of the filament end-supporting member is omitted and the filament F is directly attached to the retainer plate 21. See for example, Japanese Unexamined Patent Publication No. 2011-243377.

FIGS. 5A and 5B are cross-sectional views of a driving IC-incorporated fluorescent display device, which employs the firmament end-supporting member having no support, as the shielding member.

FIG. 5A is a cross sectional view of FIG. 5B taken along line X23-X23, and FIG. 5B is a cross sectional view of FIG. 5A taken along line X22-X22.

The end portion of the filament F is sandwiched between a tabular member 262 of a retainer plate 26 also having a function as a support and the ribbon 23, and the ribbon 23 is fixed to the tabular portion 262 by spot welding. If the filament F is brought in contact with the tabular portion 262, the heat of the filament F is transferred to the tabular portion 262. As a so-called end cool region increases, the tabular portion 262 has a plurality of comb-like slits (i.e., opening portions) 262*s* at an area with which the filament F is in contact.

The filament end-supporting member in FIG. 5 does not provide for the support as shown in FIG. 3, and the height of the filament F can be decreased accordingly. Furthermore, reference numeral 261 represents a rising portion of the retainer plate 26.

A conventional filament end-supporting member in which a support is omitted provides advantages of decreasing a height of a filament. On the other hand, the conventional filament end-supporting member has disadvantages as mentioned below.

In FIG. 5, the retainer plate 26 is fixed between the anode substrate 11 and the side plate (side member) 12 at the area of X21 by the glass-based adhesive, and Alloy 42-6 thermal expansion coefficient of which is comparable to that of the adhesive is used, in order to prevent crack creation at the area of X21. Alloy 42-6 forms Cr oxide film by being subjected to heating treatment in hydrogen atmosphere in order to enhance adhesive strength to glass and air tightness. For the reasons, when the filament F is directly attached to the retainer plate 26 by welding, the welding strength can be lowered.

Also, as the slits 262*s* are formed just under the filament F, there is a risk that electrons which are emitted from the filament F may reach the driving IC 24 through the slits 262*s*. In this case, shielding effect might be compromised. Similarly, in the configuration in which the slits 262*s* are formed in the retainer plate 26, due to the three-dimensional conformation of the retainer plate 26 there is a risk of causing decrease in strength.

SUMMARY OF THE INVENTION

To provide a driving IC-incorporated fluorescent display device with providing a filament end-supporting member having a structure which can be lowered a height of the filament than that of the conventional one while taking such kinds of hitherto known problems of a conventional filament support portion omitting a support.

In order to achieve the purpose, the driving IC-incorporated fluorescent display device described in claim 1 is characterized that, according to the filament end-supporting member covering the driving IC so as to shield the driving IC against a filament, the filament end-supporting member is provided with a retainer plate disposed inside the air tight container, and a tabular support attached to the retainer plate, the support includes a slit opposed to the filament and opened at an anchor side, an one end portion of the filament is fixed to the support such that the filament extends in a longitudinal direction of the slit, and the slit of the support is closed by the retainer plate at a side opposite to the filament.

The driving IC-incorporated fluorescent display device described in claim 2 is characterized that, according to the driving IC-incorporated fluorescent display device describing in claim 1, the retainer plate includes a rising portion and a tabular portion, and the support is attached to the tabular portion of the retainer plate.

The driving IC-incorporated fluorescent display device described in claim 3 is characterized that, according to the driving IC-incorporated fluorescent display device describing in claim 1 or 2, the slit is provided for each filament, and comb-shaped.

The driving IC-incorporated fluorescent display device described in claim 4 is characterized that, according to the driving IC-incorporated fluorescent display device describing in any one of claim 1-3, the filament comprises a core wire, and the electron emission material is deposited on the surface of the core wire except for a portion between an end of the core wire and a non-opening end of the slit.

The driving IC-incorporated fluorescent display device described in claim 5 is characterized that, according to the driving IC-incorporated fluorescent display device describing in any one of claims 1-4, a distance between the filament and an anode substrate is 1 mm or less.

The driving IC-incorporated fluorescent display device described in claim 6 is characterized that, according to the driving IC-incorporated fluorescent display device describing in any one of claims 1-5, the retainer plate is disposed such that an end portion of the tabular portion at an anchor side is bent in a direction approaching an anode substrate side.

The driving IC-incorporated fluorescent display device described in claim 7 is characterized that, according to the driving IC-incorporated fluorescent display device describing in any one of claims 1-6, the slits of the support is spot welded to the tabular portion of the retainer plate.

The driving IC-incorporated fluorescent display device described in claim 8 is characterized that, according to the driving IC-incorporated fluorescent display device describing in any one of claims 1-7, the retainer plate includes an oxide film.

The filament end-supporting member of this invention is formed of the retainer plate and the support, and the filament is directly fixed to the tabular portion of the support. For the reason, the distance between the filament F and an anode electrode (height of the filament) becomes small. In other words, the height of the filament becomes low.

As the support of the filament end-supporting member is formed of a U-shaped slit which is opposed to the filament, even if the end portion of the filament is directly fixed to the support, the range that the filament is in contact with the support becomes narrow, thereby narrowing the end cool region.

The slit of the support of this invention is closed by the retainer plate in the opposite side of the filament, hence the electrons emitted from the filament does not reach to the driving IC through the slit. In other words, even if the slit is formed in the support, the shielding effect of the filament end-supporting member is not compromised.

The support has a simple tabular structure. As a result, the processing is simplified and manufacturing cost can be saved. Also, the retainer plate functions as a reinforcing material, therefore the support can be made thin.

Figure 1A:
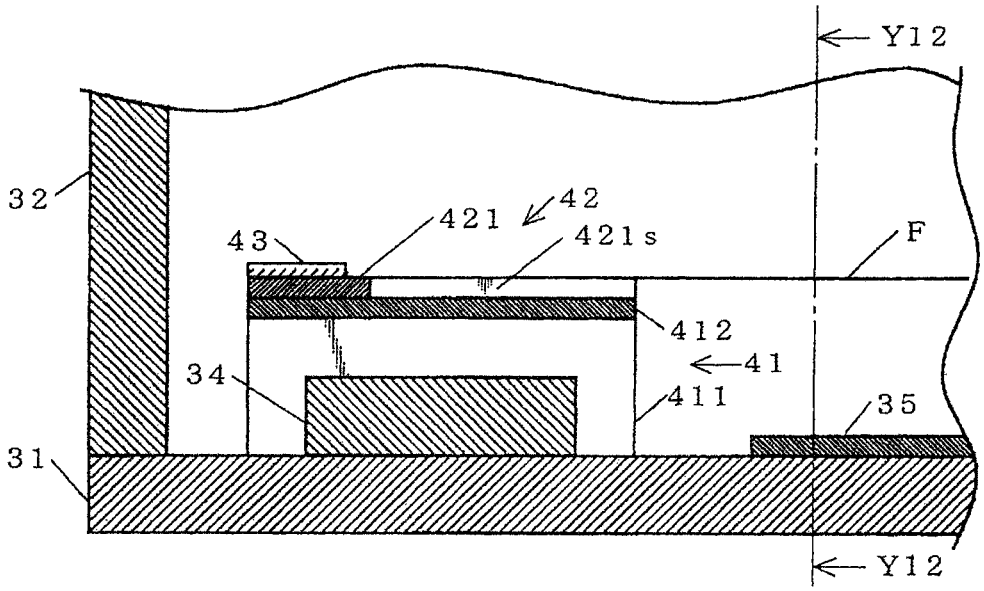
FIGS. 1A and FIG. 1B are cross sectional views indicating a driving IC-incorporated fluorescent display device including a one embodiment of a filament end-supporting member in accordance with the invention.
Figure 1B:
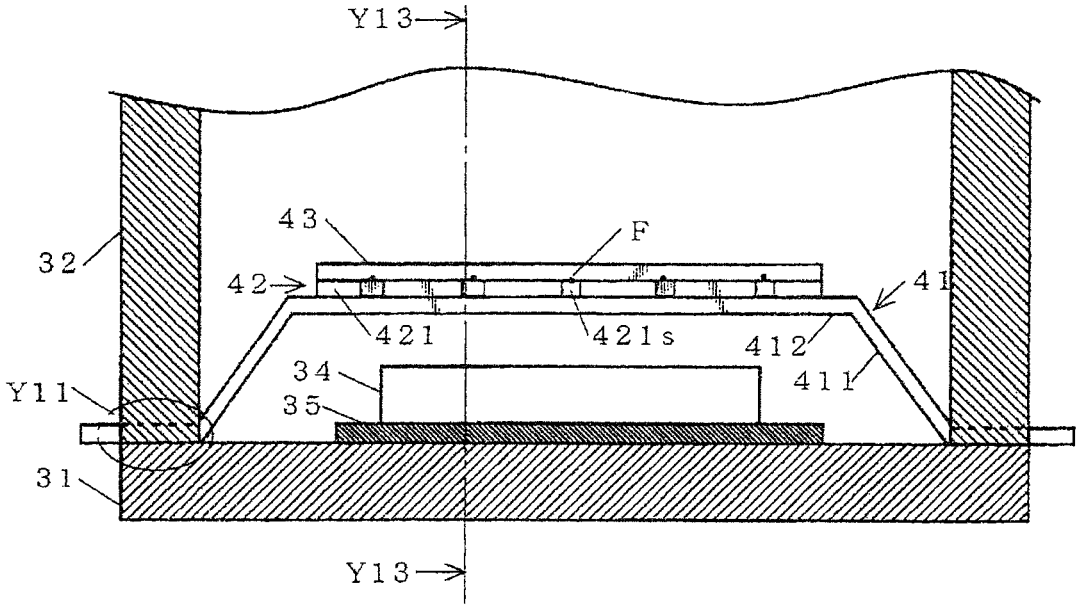
Figure 2A:
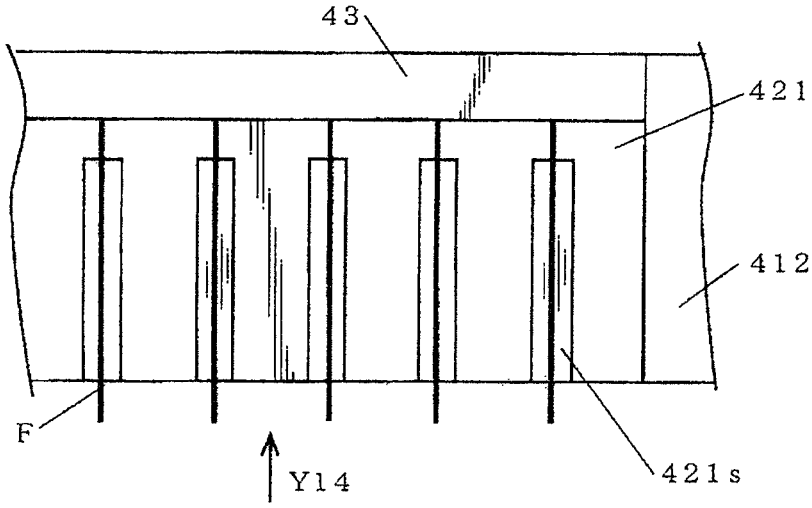
Figure 2B:
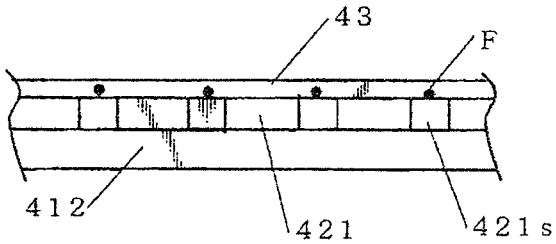
Figure 2C:
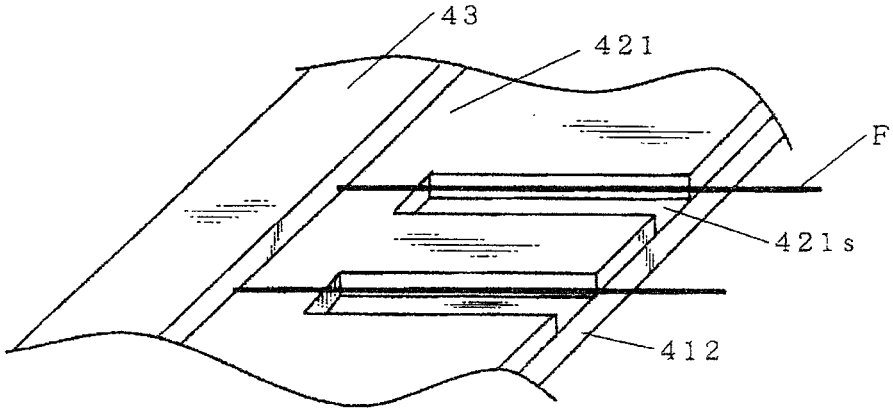

Each of FIGS. 2A, 2B and 2C is an enlarged view of a part of the driving IC-incorporated fluorescent display device of FIGS. 1A and 1B.

Figure 3A:
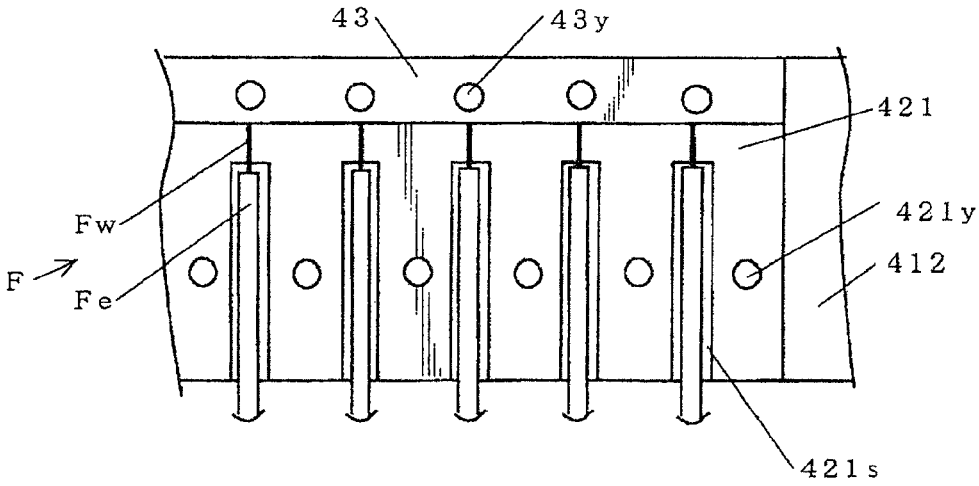
Figure 3A:
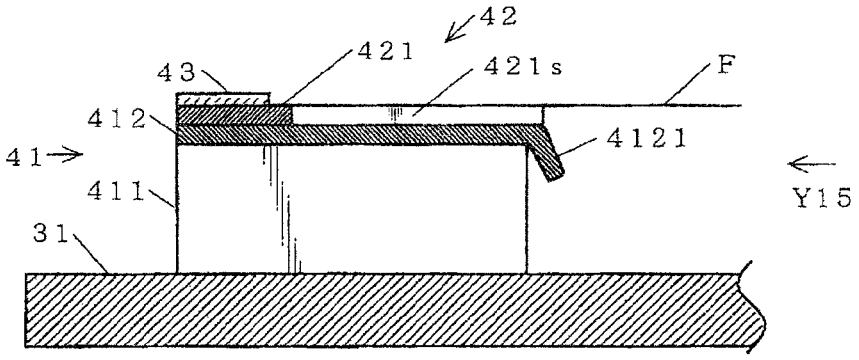
Figure 3A:
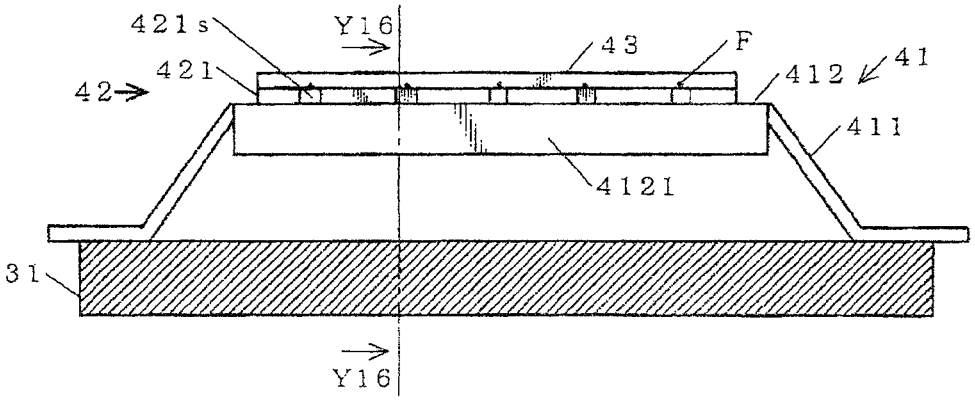

FIG. 3A is a view describing an adhered range of an electron emission material of the filament and a welding portion between the support and the filament, and FIGS. 3B1 and 3B2 are views describing a reinforcing portion of the retainer plate.

Figure 4A:
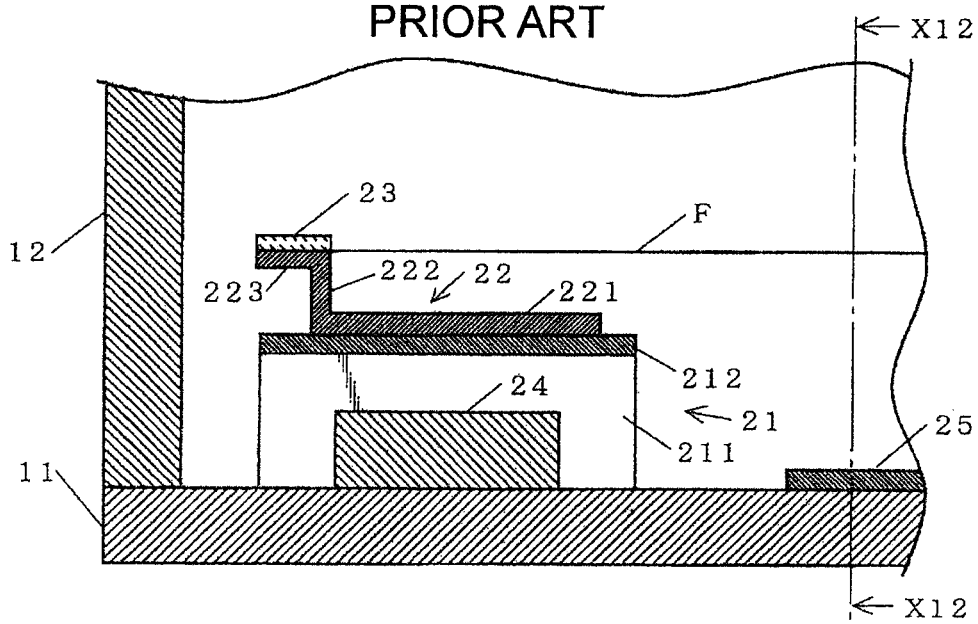
FIG. 4A PRIOR ART
Figure 4B:
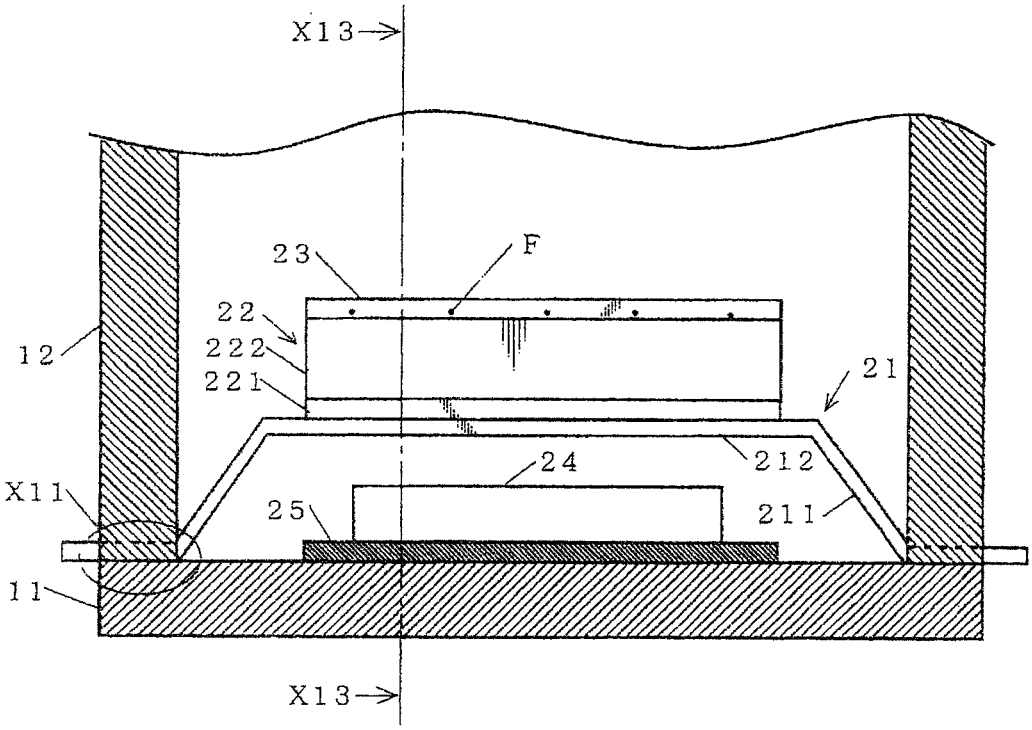
FIG. 4B PRIOR ART

FIG. 4A and 4B are cross sectional views of a conventional driving IC-incorporated fluorescent display device including a filament end-supporting member with providing the support.

Figure 5A:
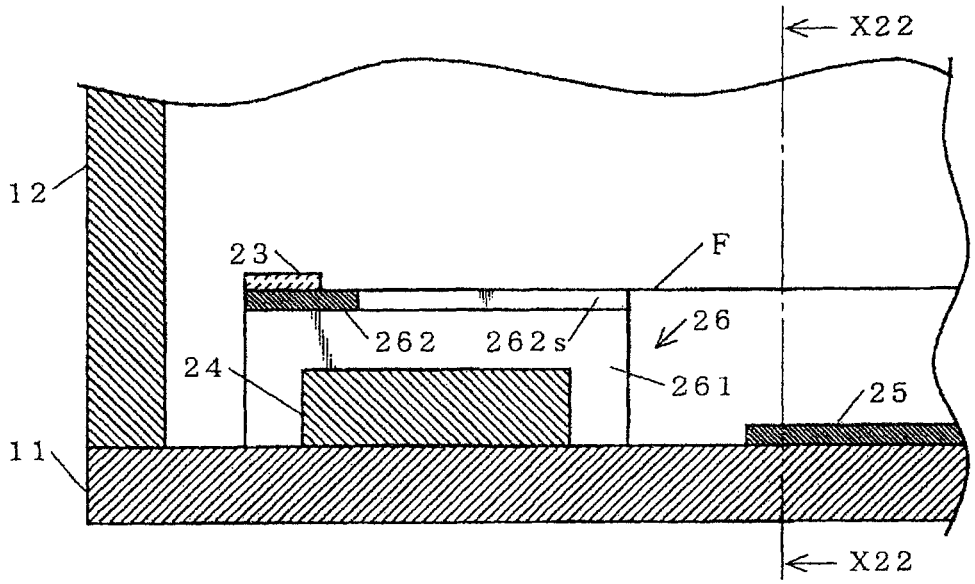
FIG. 5A PRIOR ART
Figure 5B:
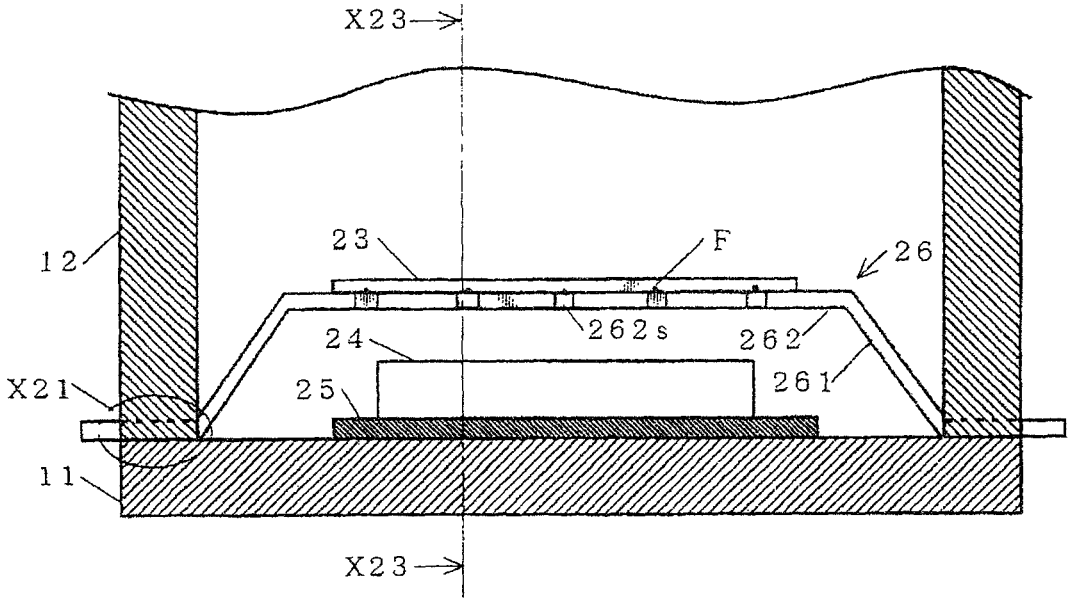
FIG. 5B PRIOR ART

FIG. 5A and 5B are cross sectional views of a conventional driving IC-incorporated fluorescent display device including a filament end-supporting member without providing the support.

DESCRIPTION OF THE EMBODIMENTS

A driving IC-incorporated fluorescent display device provided with a filament end-supporting material in accordance with an embodiment of this invention is described by using FIGS. 1 and 2.

FIG. 1 is a cross sectional view of a driving IC-incorporated fluorescent display device, and FIG. 2 is an enlarged view of one part of FIG. 1.

In FIG. 1A is a cross sectional view of FIG. 1A taken along the line Y13-Y13, and FIG. 1B is a cross sectional view of FIG. 1A taken along the line Y12-Y12.

An enclosure of a fluorescent display device (i.e., vacuum air tight container) has a structure in which an anode substrate 31, a substrate opposed to the anode substrate 31 (not shown), and a side plate (side member) 32 which is interposed between an anode substrate 31 and the substrate are sealed by low melting point glass (i.e., frit glass) . The enclosure includes a filament F emitting electrons (i.e., a cathode), an anode electrode 35 having a fluorescent film which emits light by impact of electrons emitted from the filament F, a control electrode controlling electrons emitted from the filament F which is provided between the filament F and a anode electrode 35 (not illustrated), and a driving IC 34 of the fluorescent display device. The driving IC 34 is connected with wires (not illustrated) which are formed on the anode substrate 31 by bonding wires (not illustrated). The end portion of the filament F is attached and fixed to the filament end-supporting member, which includes a retainer plate 41 and a support 42.

The retainer plate 41 is attached to an inner surface of the anode substrate 31 and the support 42, and the support 42 is attached and fixed to the end portion of the filament F.

The retainer plate 41 includes a tabular both end portions (i.e. fixing portions) fixed to the anode substrate 31, rising portions 411 respectively connected each of the both end portions, and a tabular portion 412 connecting the rising portions 411. The retainer plate 41 is formed in a trapezoidal shape (or rectangular shape) in which the tabular portion 412 corresponds to as upper base and the both end portions (i.e., virtual line formed by connecting both end portions) correspond to a bottom base. The both end portions of the retainer plate 41 are drawn from a joint Y11 between the anode substrate 31 and the side plate (i.e., side member) 32 to outside of an enclosure. The support 42 is formed of a tabular member, and a slit (i.e., an opening) 421*s* is formed in the tabular member 421. The slit 421*s* is provided for each filament and may be comb-shaped. Furthermore, the slit 421*s* is opposed to the filament F, and formed in U-shaped with opening the opposite side of the end portion of the filament F [at the anchor side (not illustrated), the right side in FIG. 1B].

The support 42 is spot welded to the tabular portion 412 of the retainer plate 41. The filament F is sandwiched at its one end portion between the tabular member 421 of the support 42 and a ribbon 43, and the ribbon 43 is spot welded to the tabular member 421 of the support 42. Also, other end portion of the filament F is fixed to an anchor formed of a metallic plate having elasticity (not illustrated). The anchor is generally formed of stainless steel spring material such as SUS 304, SUS 631, etc.

Furthermore, a joint between the support 42 and the filament F is described below.

The support 42 is tabular and is not three-dimensional structure such as a conventional support. For the reasons, in the filament end-supporting member of this embodiment, the distance between the filament F and the anode substrate 31 (i.e., the height of the filament) can be decreased in comparison to the conventional three-dimensional support. The distance between the filament F and the anode substrate 31 (i.e., the height of the filament) depends on the height of the rising portion 411 of the retainer plate 41 and the thickness of the tabular member 421 of the support 42. For the reason, even if the support 42 is used, the distance would be merely increased by the thickness of the support 42 used, in comparison to a case in which the filament is directly attached to the conventional retainer plate 41.

The support 42 has a simple tabular structure, and the slit 421*s* can be formed by using a press die or etching. As a result, the processing is simplified and manufacturing cost can be saved. Also, even if the slit 421*s* is formed in the support 42, the retainer plate 41 functions as a reinforcing material, and overall intensity is not thus deteriorated. Therefore, the support 42 can be made thin.

With reference to FIG. 1, the dimension of each member of a driving IC-incorporated fluorescent display device is as follows.

The distance between the anode substrate 31 and the filament F (distance between an insulating layer and the filament F, when the insulating layer is formed on the surface of the anode substrate 31) is 1 mm, the distance between the anode substrate 31 and the lower surface of the retainer plate 41 is 0.6 mm, the thickness (i.e., plate thickness) of the retainer plate 41 is 0.2 mm, the thickness (i.e., plate thickness) of the support 42 is 0.1 mm, and the thickness of the driving IC is 0.2 mm (because the retainer plate 41 rise up, it has a margin).

The positional relationship between the filament F and the slit 421*s* of the support 42 is described with reference to FIG. 2.

FIG. 2A is an enlarged planer view of the retainer plate 41, the support 42, and the ribbon 43; FIG. 2B is a side view of one portion of FIG. 2A in Y14 direction, and FIG. 2C is a perspective view of the slit 421*s* of the support 42.

The planar shape of the slit 421*s* is U-shaped, and the slit 42 is opened at the end portion of the filament F or the side away from the ribbon 43 [anchor side (not illustrated)]. The filament F is opposed to the slit 421*s* and extends in a longitudinal direction of the slit 421*s*. As the support 42 has the slit 421*s* disposed therein, even if the filament F is fixed to the support 42 with a tabular shape, the filament F does not come in contact with the support 42 except for the neighborhood of the ribbon 43. Therefore, even if the end portion of the filament F is directly fixed to the support 42, the area that the filament F is in contact with the support 42 becomes narrow, thereby narrowing the end cool region.

The filament F may be formed by the deposition of an electron emission material, which may be formed of, for example, a carbonate of alkaline earth metal, on the surface of a core wire formed of, for example, tungsten having a diameter of from several μm to several ten μm. The carbonate of alkaline earth metal which can be used includes, but is not limited to, a ternary carbonate in which BaCO3, SrCO3, and CaCO3 are blended in a specified ratio.

Further, the deposition range or area of the electron emission material is described below.

As the tabular portion 412 of the retainer plate 41 and the support 42 are disposed to cover the driving IC 34, they also have the function of shielding the driving IC against electrons emitted from the filament F. In other words, the filament end-supporting member, including the retainer plate 41 and the support 42 also function as a shielding member of the driving IC. In this regard, the longitudinal direction of the slit 421*s* corresponds to a direction along which the filament F is stretched, and a direction in which the opened portion of the slit 421*s* is passed. By adopting the above configuration, the electrons emitted from the filament F do not reach the driving IC through the slit 421*s*. In other words, even if the slit 421*s* is formed in the support 42, the shielding effect of the retainer plate 41 and the support 42 is not compromised.

The retainer plate 41 and the support 42 may be formed of material which is conventionally used. The retainer plate 41 may be formed of Alloy 42-6 having thermal expansion coefficient being close to that of the glass adhesive (i.e., frit glass). The material, Alloy 42-6 may be heated in hydrogen atmosphere, thereby forming Cr oxide film on the surface of the material. Also, the support 42 may be formed of Alloy 36, SUS 430, SUS 304, and etc. in addition to Alloy 42-6. These materials can be used without the heating treatment in hydrogen atmosphere.

Next, the range or area in which the electron emission material of the filament F is deposited, and a position or site in which the support 42 is welded to the filament F will be described with reference to FIG. 3A. FIG. 3A is a drawing corresponding to FIG. 2A.

The electron emission material Fe is deposited on the surface of the core wire Fw of the filament F. The core wire Fw may be formed of Tungsten. The electron emission material Fe is deposited to an extent where the filament F is opposed to the slit 421*s*, except for a portion between the end portion of the slit 421*s* of the support 42 (i.e., the end portion of non-opening side) and the end portion of the core wire Fw. The electron emission material Fe may be firstly deposited on the entire surface of the core wire Fw, and unnecessary portion is then removed from the deposited layer of the electron emission material Fe to expose the core wire Fw. Alternatively, the electron emission material Fe may not be originally deposited on the surface of the core wire Fe which does not need the layer of the electron emission material Fe.

The tabular member 421 of the support 42 is welded to the tabular portion 412 of the retainer plate 41 at first, the end portion of the core wire Fw of each filament F is then sandwiched between the tabular member 421 of the support 42 and the ribbon 43, and the ribbon 43 is then fixed to the tabular member 421 of the support 42 at the welding position 43*y* via spot welding, while the filament being sandwiched therebetween.

Also, the support 42, in particular, the portion between the slit 421*s* and the slit 421*s* of the tabular member 421 (i.e., a portion of the teeth of the comb) is spot welded to the tabular portion 412 of the retainer plate 41. As a result, the tabular member 421, in particular, the portion of the teeth of the comb has increased intensity or strength.

Next, the retainer plate 41 in which reinforcing portion is formed is described with reference to FIGS. 3B1 and 3B2.

FIG. 3B1 is a cross-sectional view of FIG. 3B2 taken along the line Y16-Y16, and FIG. 3B2 is a side view of FIG. 3B1 as viewed in Y15 direction. FIG. 3B2 corresponds to a cross-sectional view of only the anode substrate.

The end portion at anchor side of the tabular portion 412 of the retainer plate 41 forms the reinforcing portion 4121, which is bent in a direction approaching the anode substrate 31. The tabular portion 412 of the retainer plate 41 has the reinforcing portion 4121, which is obtained by bending the end portion of the tabular portion 412. As a result, the tabular portion 412 has enhanced strength and is not subjected to deformation.

Furthermore, the aforementioned embodiments are only shown some representatives of this invention, and this invention is not limited of these embodiments. Therefore, it can be performed with several changes without deviating from the scope of this invention.

REFERENCE SIGNS LIST

31 anode substrate
32 side plate (side member)
34 driving IC
35 anode electrode
41 retainer plate
4121 reinforcing portion
42 support
421*y* welding portion
421*s* slit
43*y* welding portion
43 ribbon
F filament (cathode)

What is claimed is:

1. A fluorescent display device, comprising:

a driving IC disposed in an air tight container; and a filament end-supporting member including a retainer plate covering the driving IC so as to shield the driving IC against a filament, the filament end-supporting member and the retainer plate disposed inside the air tight container; and a tabular support attached to an upper surface of the retainer plate, wherein the tabular support comprises a slit opposed to the filament and opened at an anchor side, wherein an end portion of the filament is fixed to the tabular support such that the filament extends in a longitudinal direction of the slit, and wherein the slit of the tabular support is closed by the retainer plate at a side opposite to the filament.

2. The fluorescent display device according to claim 1, wherein the retainer plate comprises a rising portion and a tabular portion, and wherein the support is attached to the tabular portion of the retainer plate.

3. The fluorescent display device according to claim 1, wherein the slit is provided for each filament, and comb-shaped.

4. The fluorescent display device according to claim l, wherein the filament comprises a core wire, and an electron emission material deposited on a surface of the core wire, wherein the electron emission material is deposited on the surface of the core wire except for a portion between an end of the core wire and a non-opening end of the slit.

5. The fluorescent display device according to claim 1, wherein a distance between the filament and an anode substrate is 1 mm or less.

6. The fluorescent display device according to claim 1, wherein the retainer plate is disposed such that an end portion of the tabular portion at an anchor side is bent in a direction approaching an anode substrate side.

7. The fluorescent display device according to claim 1, wherein a portion between the slits of the support is spot welded to the tabular portion of the retainer plate.

8. The fluorescent display device according to claim 1, wherein the retainer plate comprises an oxide film.

* * * * *